US011535923B2

(12) United States Patent
Kim

(10) Patent No.: US 11,535,923 B2
(45) Date of Patent: Dec. 27, 2022

(54) METHOD FOR MANUFACTURING MOLTEN GALVANIZED STEEL SHEET

(71) Applicant: M.E.C CO., LTD, Gwangyang-si (KR)

(72) Inventor: Sang-Ho Kim, Gwangyang-si (KR)

(73) Assignee: M.E.C CO., LTD, Gwangyang-si (KR)

( * ) Notice: Subject to any disclaimer, the term of this patent is extended or adjusted under 35 U.S.C. 154(b) by 55 days.

(21) Appl. No.: 17/312,957

(22) PCT Filed: Aug. 8, 2019

(86) PCT No.: PCT/KR2019/009984
§ 371 (c)(1),
(2) Date: Jun. 11, 2021

(87) PCT Pub. No.: WO2020/122352
PCT Pub. Date: Jun. 18, 2020

(65) Prior Publication Data

US 2022/0056570 A1 Feb. 24, 2022

(30) Foreign Application Priority Data

Dec. 11, 2018 (KR) ..... 10-2018-0158942
Dec. 11, 2018 (KR) ..... 10-2019-0080538

(51) Int. Cl.
*C23C 2/40* (2006.01)
*C23C 2/06* (2006.01)
*C23C 2/26* (2006.01)

(52) U.S. Cl.
CPC ..... *C23C 2/40* (2013.01); *C23C 2/06* (2013.01); *C23C 2/26* (2013.01)

(58) Field of Classification Search
CPC ..... C23C 2/40; C23C 2/06; C23C 2/26
See application file for complete search history.

(56) References Cited

U.S. PATENT DOCUMENTS

2016/0304984 A1* 10/2016 Genaud ..... C23G 3/028

FOREIGN PATENT DOCUMENTS

KR 10-0504370 B1 7/2005
KR 100504370 B1 * 7/2005 ..... C23C 2/26
(Continued)

OTHER PUBLICATIONS

KR101879084 B1 English translation (Year: 2018).*
(Continued)

*Primary Examiner* — Hai Y Zhang
(74) *Attorney, Agent, or Firm* — Eric L. Lane; Green Patent Law

(57) ABSTRACT

The present invention relates to a molten metal plated steel sheet manufacturing method for cooling a molten galvanized layer with high efficiency when manufacturing a molten galvanized steel sheet, and the purpose of the present invention is to provide a method for manufacturing a molten galvanized plating, wherein a molten galvanized steel sheet having an aesthetically pleasing surface without fitting defects, drop mark defects, and linear comb-pattern defects can be stably obtained by cooling a galvanized layer with high efficiency during a molten metal plated steel sheet manufacturing process. This method for manufacturing a molten galvanized steel sheet having excellent surface properties is characterized by comprising the steps in which a molten galvanized layer is formed on the surface of a steel sheet while the steel sheet passes through a galvanizing pot, the thickness of the galvanized layer formed on the surface of the steel sheet is adjusted while the steel sheet passes through a gas wiping device, the steel sheet that has had the thickness of the galvanized layer adjusted undergoes a primary cooling while passing through a bottom cooler, and the galvanized steel sheet that has undergone the primary cooling undergoes a secondary cooling while passing
(Continued)

through a cooling chamber, wherein: the primary cooling is performed with cooling air blown from the bottom cooler until right before a galvanizing solution of the galvanized layer attached to the surface of the steel sheet becomes solidified, the amount of air blown being adjusted according to the temperature of the galvanized layer attached to the surface of the steel sheet; and the secondary cooling is performed with ionic air generated from an ionic air generator provided in the cooling chamber and a spray solution sprayed from a solution atomization part, the secondary cooling being performed from the start of the solidification of the galvanizing solution until the end of the solidification, and the cooling chamber cooling the galvanized steel sheet while moving up and down according to the temperature of the galvanized layer attached to the surface of the galvanized steel sheet.

9 Claims, 13 Drawing Sheets

(56) References Cited

FOREIGN PATENT DOCUMENTS

| | | | | | |
|---|---|---|---|---|---|
| KR | 10-1795965 | B1 | | 11/2017 | |
| KR | 101795965 | B1 | * | 11/2017 | ..... C23C 2/26 |
| KR | 10-1879084 | B1 | | 8/2018 | |
| KR | 101879084 | B1 | * | 8/2018 | ..... C23C 2/26 |

OTHER PUBLICATIONS

KR100504370 B1 English translation (Year: 2005).*
KR101795965 B1 English translation (Year: 2017).*
J. Korean Inst .of Illuminating and Elec. Installation Eng. (2014) 28(2) p. 54-59, Kim and Jung, Characteristics of Ionic Wind Generation with Corona Electrodes in Form of Ring.
International Search Report and Written Opinion in related International Patent Application No. PCT/KR2019/009984.

* cited by examiner

【FIG. 1】
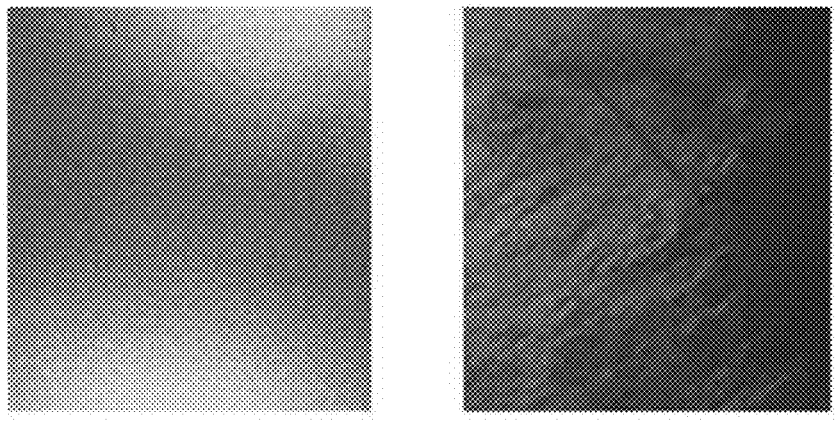
(Normal surface) (Linear comb pattern defect)

【FIG. 2】
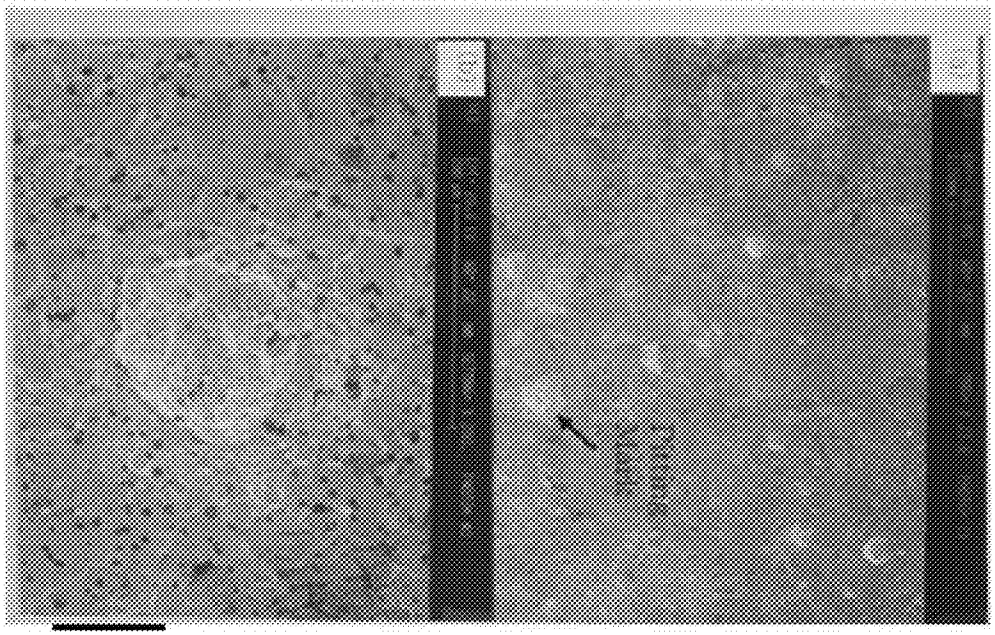

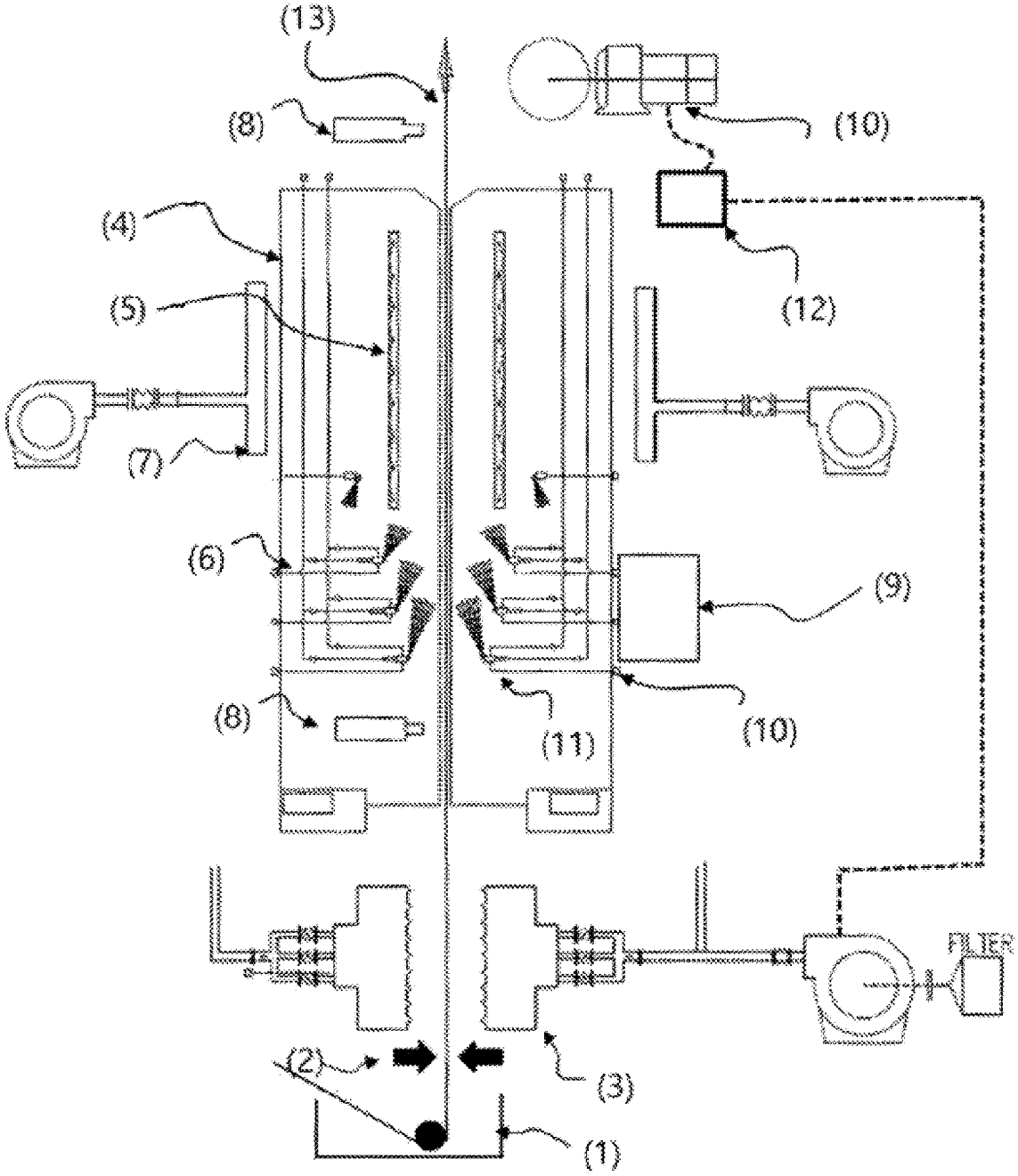
【FIG. 3】

【FIG. 4】
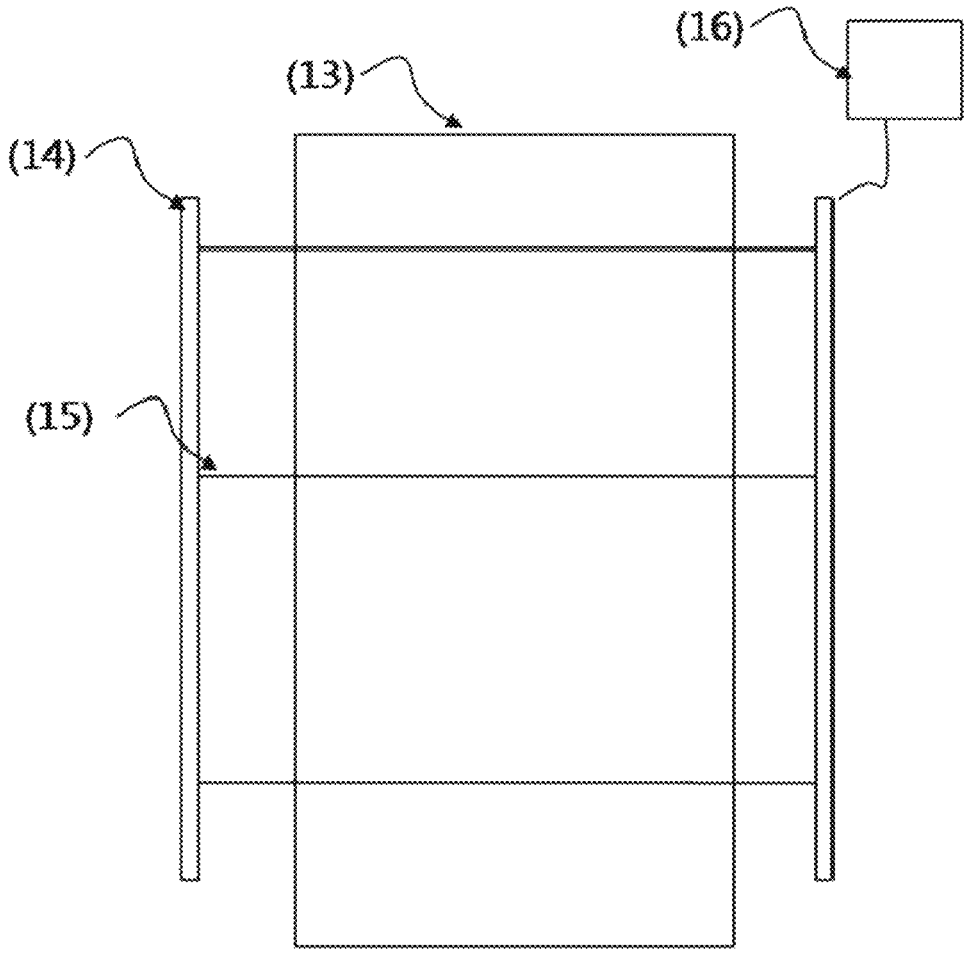

【FIG. 5】
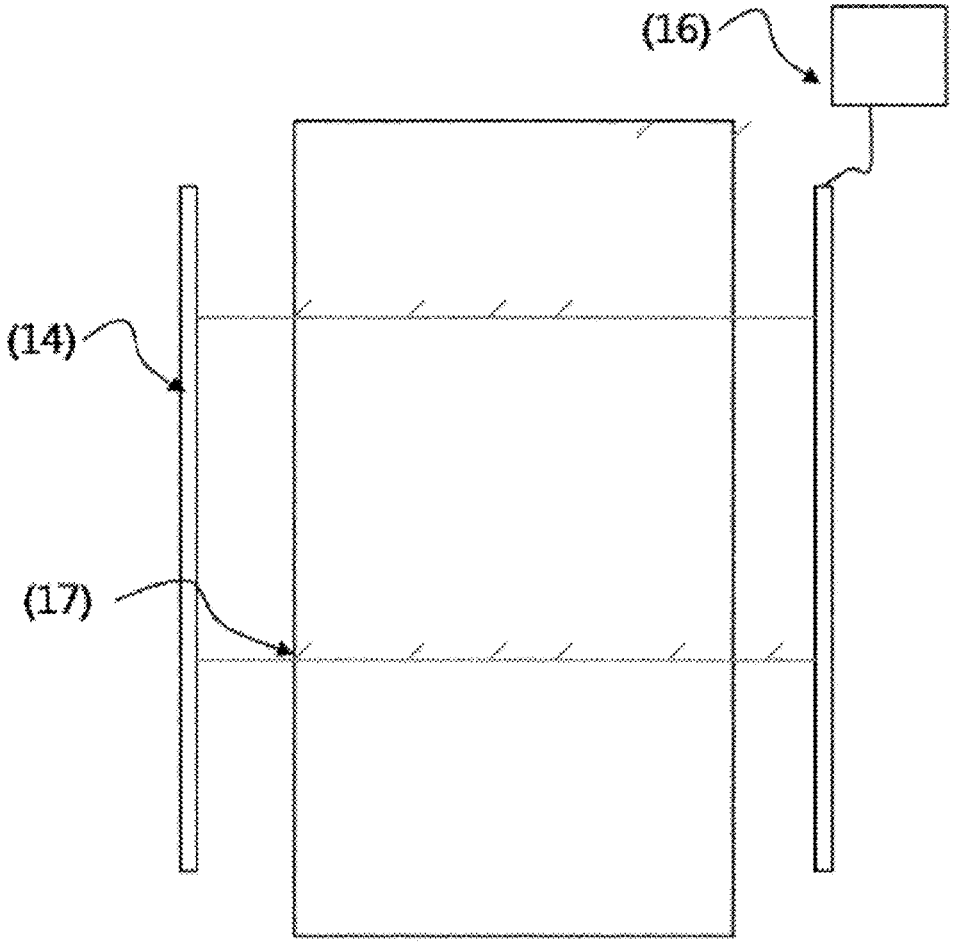

【FIG. 6】
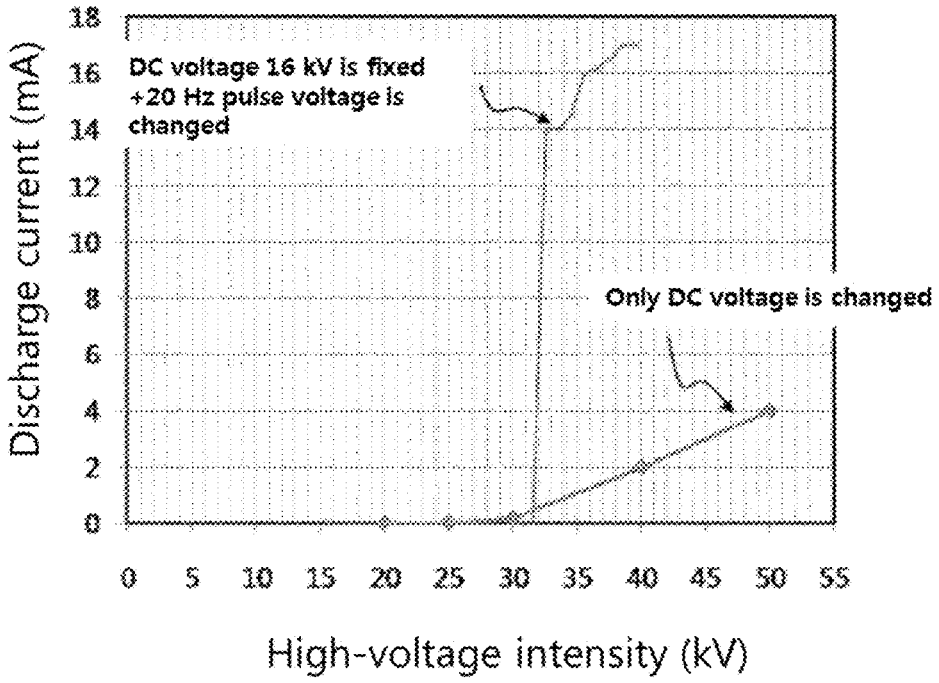

【FIG. 7】
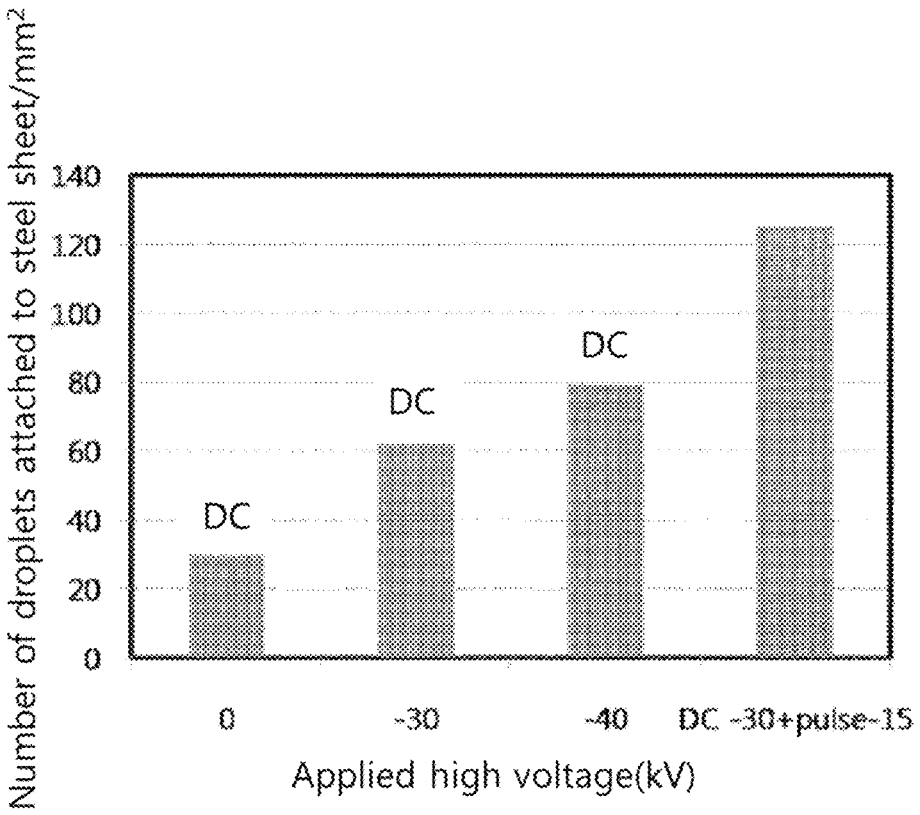

【FIG. 8】
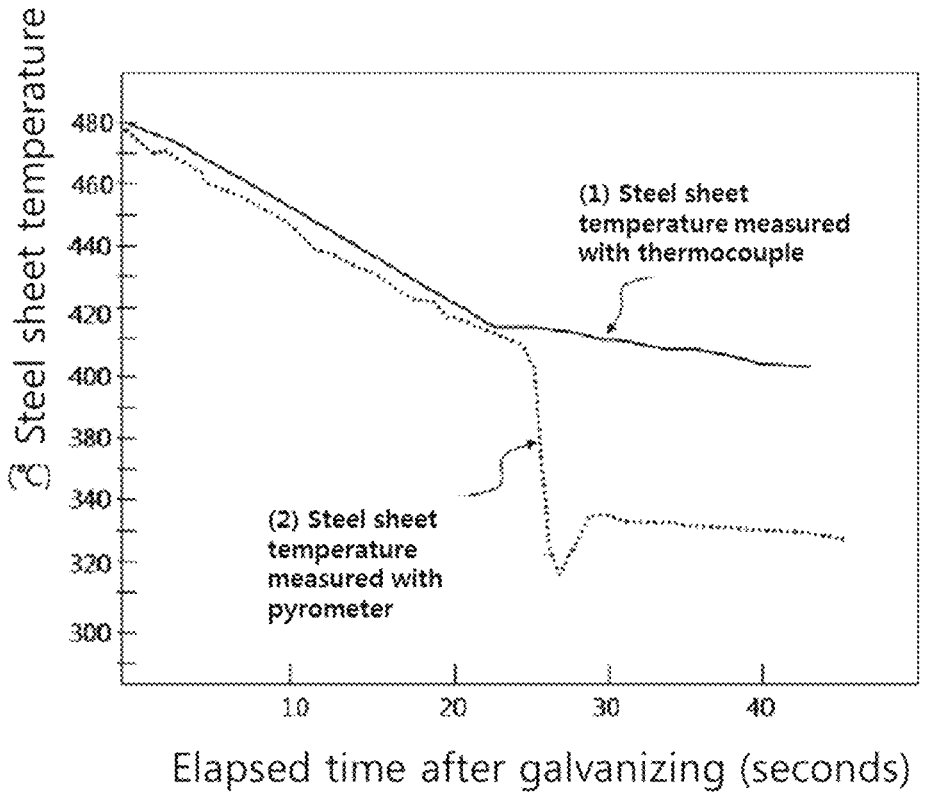

【FIG. 9】
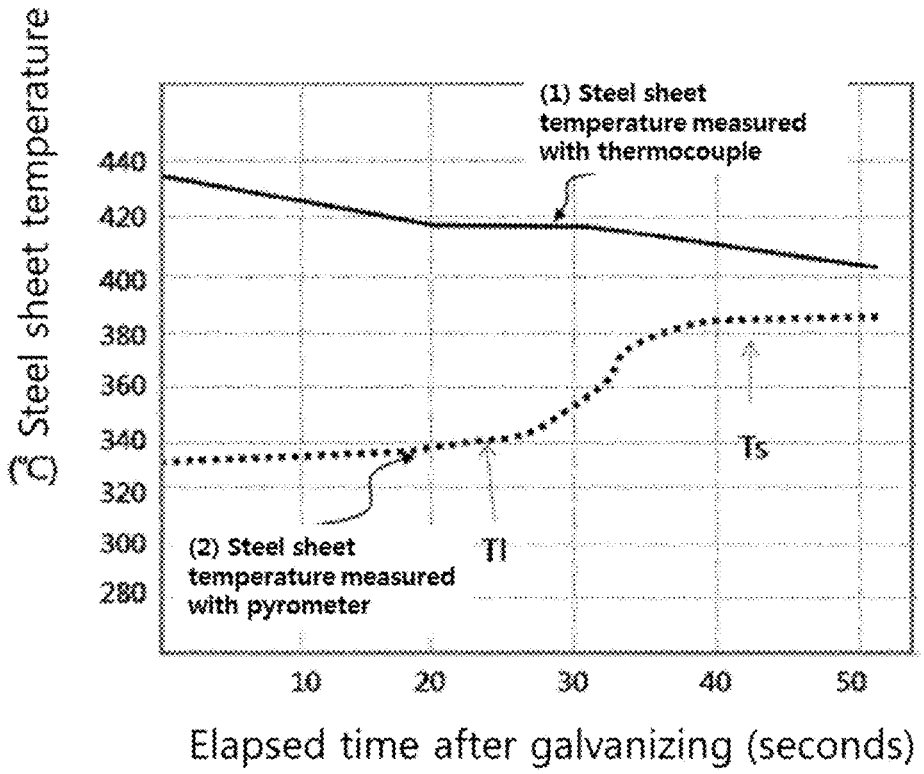

【FIG. 10】
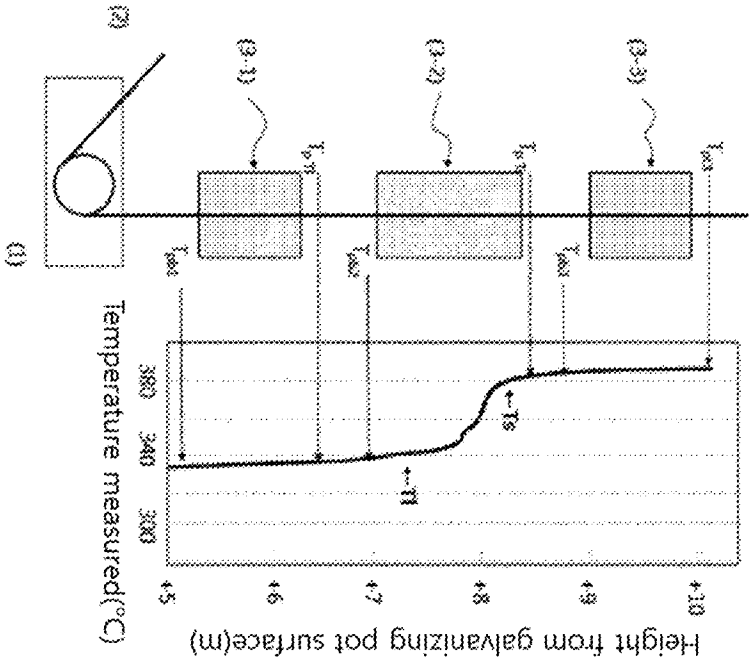

【FIG. 11】
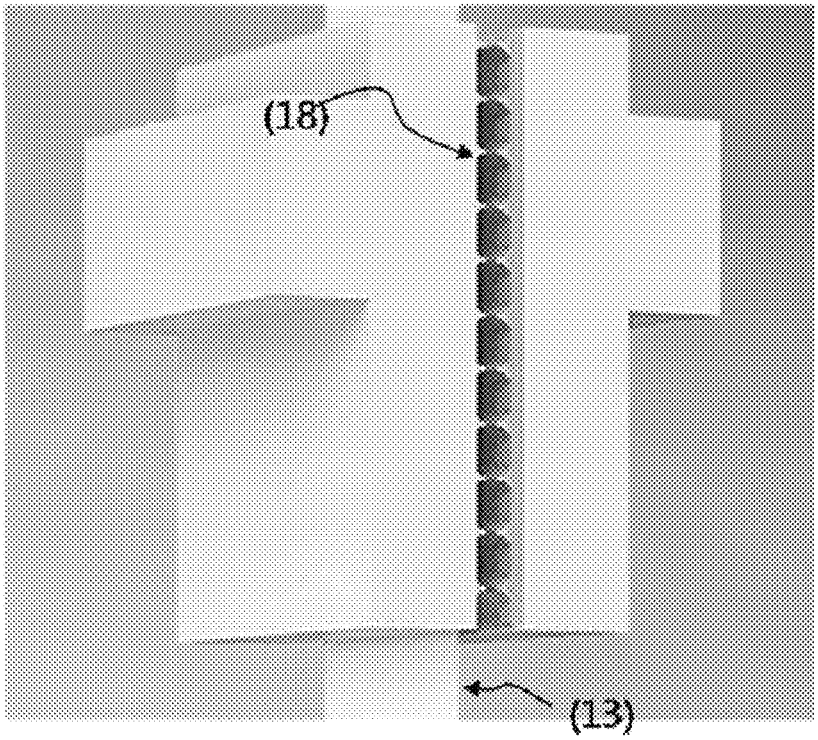

【FIG. 12】
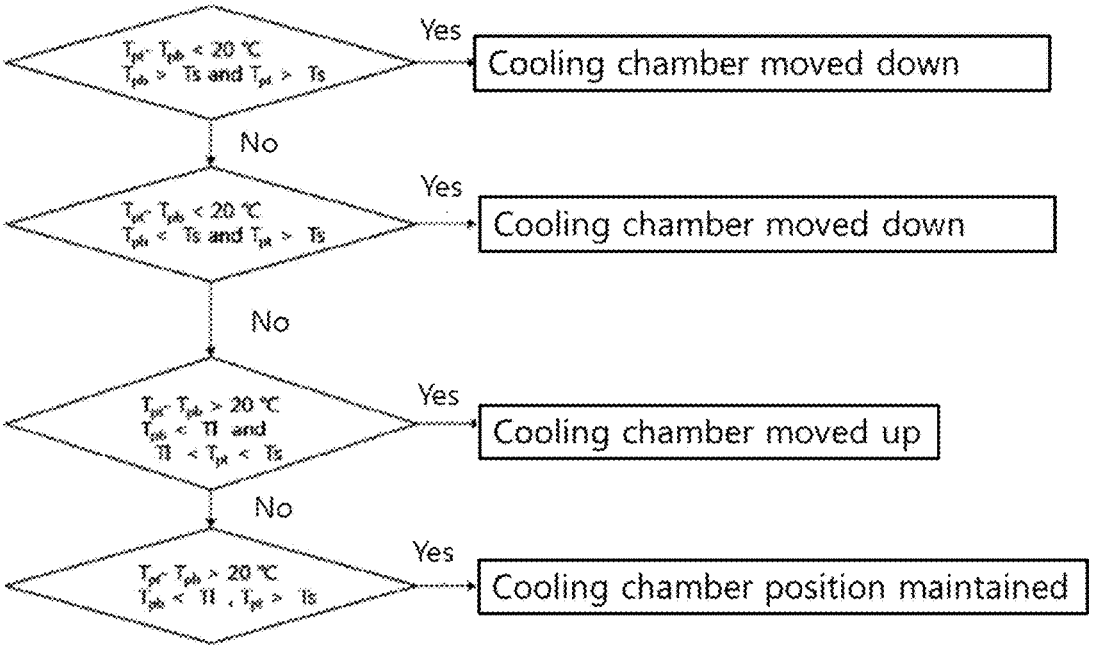

【FIG. 13】
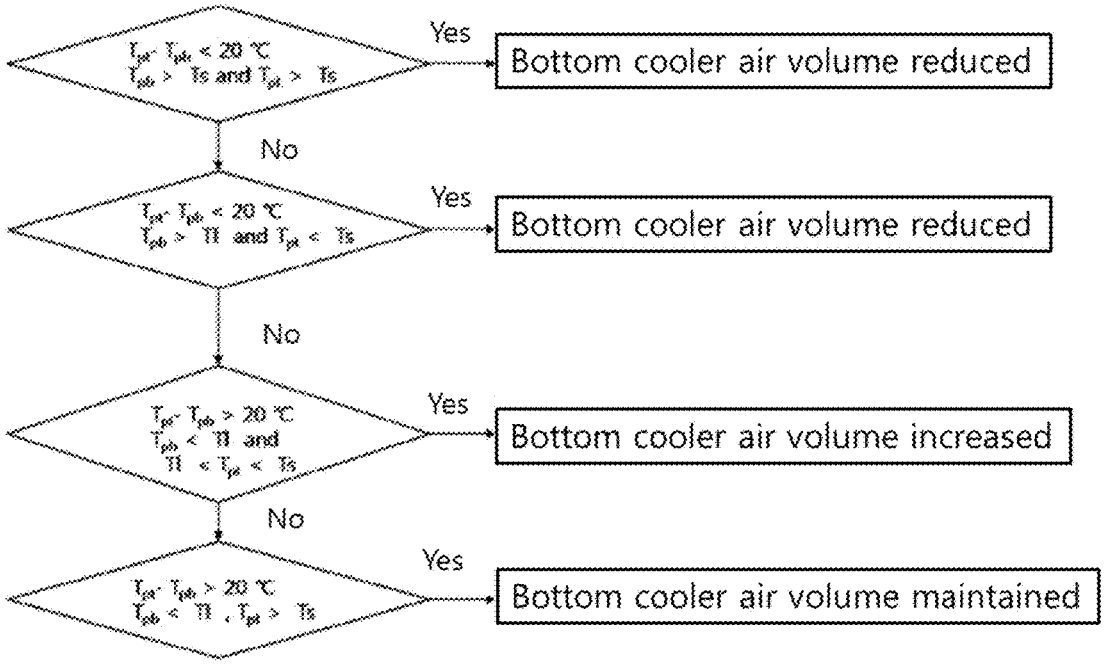

METHOD FOR MANUFACTURING MOLTEN GALVANIZED STEEL SHEET

TECHNICAL FIELD

The present invention relates to a method of manufacturing a hot-dip galvanized steel sheet including cooling a galvanized layer in a molten state with high efficiency, and more particularly, to a method of manufacturing a hot-dip galvanized steel sheet capable of stably producing a hot-dip galvanized steel sheet having an aesthetically pleasing surface by minimizing the occurrence of defects on the surface of the galvanized steel sheet.

BACKGROUND ART

A hot-dip galvanized steel sheet is manufactured by passing a steel sheet through a hot-dip galvanizing bath, achieving a desired level of galvanization by removing excess galvanizing solution attached to a surface of the steel sheet using an air knife, and then cooling the steel sheet with a cooling apparatus.

In this case, when the amount of attached galvanizing material is large and a cooling rate is low, a linear comb pattern defect illustrated in FIG. 1 occurs on the surface of the steel sheet, resulting in poor appearance. The larger the amount of attached galvanizing material or the thicker the steel plate, the slower the cooling rate, so the higher the probability that the defect will occur.

In order to reduce the above-described linear comb pattern defect, the galvanized layer should be solidified quickly, and for this, a high-efficiency cooling apparatus is needed.

The following are related-art techniques using a high voltage in a galvanized-layer cooling apparatus.

U.S. Pat. No. 4,500,561 (Feb. 19, 1985) and Korean Patent Publication No. 2000-0045528 relate to methods in which an electric field is formed and droplets are attached to a surface of a steel sheet using the formed electric field, and the purpose of this is to reduce the size of spangle formed on a galvanized layer. When droplets are sprayed onto a galvanized layer in a molten state, defects such as pitting marks illustrated in FIG. 2 are likely to occur. That is, a pitting mark, which refers to a indentation flaw formed on a galvanized layer, is formed when the sprayed droplets collide with the molten galvanized layer, and the higher the temperature of the steel sheet, the higher the probability that the defect will occur.

Korean Patent Publication No. 2001-0061451 relates to a method in which aqueous solution droplets are passed through a charged electrode formed of a plurality of wires to which a high voltage is applied and then are attached to a steel sheet. In this case, since the aqueous solution droplets inevitably collide with the charged electrode while passing through the electrode, large water droplets are formed on the wires, and since the large water droplets are separated from the wires and attached to a surface of the steel sheet, there is a high probability that a drop mark defect will occur.

Korean Patent Publication No. 10-2006-0076214 relates to a hot-dip galvanized steel sheet without spangle, a method of manufacturing the same, and an apparatus used therefor, wherein the apparatus is configured so that aqueous solution droplets sprayed toward a steel sheet are passed through a high-voltage charged electrode in the form of a mesh and then attached to the steel sheet so that spraying efficiency can be increased. However, like in Korean Patent Publication No. 2001-0061451, the occurrence of a drop mark defect cannot be improved. In addition, in the relevant invention, it has been described that the droplets should be sprayed immediately before a galvanized layer solidifies, but a specific method for achieving this is not suggested.

Typically, in a continuous hot-dip galvanizing process, a non-contact optical thermometer is installed to measure the temperature of a steel sheet. When using an optical thermometer, the temperature can be accurately measured only when the emissivity of an object to be measured is correctly set. When the set emissivity is not correct, the size of a measurement error increases.

When a galvanized layer solidifies, since a phase change occurs, the emissivity value is inevitably changed. In addition, the emissivity value also changes depending on air wiping conditions, the condition of a galvanized surface after solidification, and the like, so it is very difficult to accurately measure, with an optical thermometer, the temperature of a steel sheet in a temperature range where the solidification of the galvanized layer occurs.

Although Korean Patent Publication No. 10-2006-0076214 describes that the solution should be sprayed immediately before the galvanized layer solidifies, due to the above-described reason, it may be difficult to stably produce a product in actual production. Relying on operator experience can lead to variations in quality.

Korean Patent Publication No. 10-1778457 relates to a post-process cooling apparatus for a galvanized steel sheet and a system including the same, and relates to a system capable of electrically charging cooling water due to including a charging unit installed in post-process body unit equipment in an integrated manner with a cooling water spraying unit. However, in the above invention, since the spray nozzle and the charging equipment are configured in an integrated manner, there is a risk of electric leakage, and when the leakage occurs, the effect of using high voltage is reduced.

That is, in manufacturing a hot-dip galvanized steel sheet, when the cooling rate of a galvanized layer is lowered, a comb pattern defect may occur, and when the cooling rate is increased, defects such as pitting marks or drop marks may occur. In order to solve this problem, it is preferable that a cooling solution is sprayed immediately before the galvanized layer solidifies. However, since it is difficult to accurately locate an area where solidification occurs, there is no other way than to rely on operator experience, so there is a high probability of defective products.

DISCLOSURE

Technical Problem

The present invention is directed to providing a method of manufacturing a hot-dip galvanized steel sheet, which is capable of stably producing a hot-dip galvanized steel sheet having an aesthetically pleasing surface free from pitting defects, drop mark defects, and linear comb pattern defects due to highly efficient cooling of a galvanized layer.

Technical Solution

In order to achieve the above-described objective, in the present invention, a cooling chamber for solidifying a galvanized layer in a steel sheet galvanization area is disposed at an exact point where the solidification of the galvanized layer occurs, and a cooling solution is sprayed immediately before the galvanized layer solidifies so that surface defects of a galvanized steel sheet are minimized. For this, a cooling means is moved according to the temperature of the steel sheet, cooling efficiency is increased by supplying air from the outside of the cooling chamber to the inside, and the solution is sprayed at various angles from a solution atomizing unit. The above process is detailed below.

An apparatus for manufacturing a hot-dip galvanized steel sheet used in the present invention includes, as shown in FIG. 3, a galvanizing pot 1, a gas wiping apparatus 2, and a cooling chamber 4, wherein the cooling chamber 4 is driven up or down by a cooling chamber driving device 10 and includes an ionic-wind generator 5 configured to generate ionic wind and a solution atomizing unit 6 configured to spray a solution.

In addition, the apparatus for manufacturing a hot-dip galvanized steel sheet additionally includes optical thermometers 8 installed above and below the cooling chamber 4, an air injection device 7 installed at the rear of the ionic-wind generator 5 and configured to inject air, a bottom cooler 3 installed between the gas wiping apparatus 2 and the cooling chamber 4, and a control unit 12 for controlling the cooling chamber driving device 10 to drive the cooling chamber 4 up or down and controlling the air volume of the bottom cooler 3.

The cooling chamber 4 has the cooling ability to initiate and complete the solidification of a galvanized layer therein due to having a length ensuring that the time taken for a steel plate to pass through the cooling chamber, calculated based on the moving speed of the steel sheet, is at least one second long.

The ionic-wind generator 5 includes a high-voltage charged electrode connected to a high-voltage generating device 16, wherein the high-voltage charged electrode includes wires 15 and a support 14.

A plurality of the wires 15 are installed along the moving direction of the steel sheet, and include needles 17 whose tips are directed toward the steel sheet.

The solution atomizing unit 6 is installed above or below the ionic-wind generator 5 and includes a solution spray nozzle 11 and a solution supply device 9, and the solution spray nozzle 11 is installed in two or more rows along the moving direction of the steel sheet.

The optical thermometers 8 have the same emissivity value.

The air injection device 7 is installed at the rear of the ionic-wind generator 5 and includes an air outlet for supplying air from the outside of the cooling chamber to the inside thereof, and a distance between the air outlet and the steel sheet is more than twice a distance between the steel sheet and the charged electrode.

The bottom cooler 3 includes slit nozzles 18, wherein the slit nozzles 18 are installed in one or more rows toward a wide side of the steel sheet.

The control unit 12 is configured to control the vertical driving of the cooling chamber and the air volume of the bottom cooler by comparing temperatures measured by the optical thermometers 8 with galvanized layer temperatures input to the control unit.

In the process of a method of manufacturing a hot-dip galvanized steel sheet of the present invention, a hot-dip galvanized layer is formed on a surface of a steel sheet as the steel sheet passes through a galvanizing pot, a thickness of the galvanized layer formed on the surface of the steel sheet is adjusted as the galvanized layer passes through a gas wiping apparatus, the steel sheet whose galvanized layer thickness is adjusted is primarily cooled while passing through a bottom cooler, and the primarily cooled galvanized steel sheet is secondarily cooled while passing through a cooling chamber.

The primary cooling is carried out using cooling air supplied from the bottom cooler until immediately before a galvanizing solution in the galvanized layer attached to the surface of the steel sheet solidifies, and the air volume is adjusted according to the temperature of the galvanized layer attached to the surface of the steel sheet.

The secondary cooling is carried out from a time point at which the solidification of the galvanizing solution in the galvanized layer begins to a time point at which the solidification ends, by using ionic wind generated by an ionic-wind generator provided in the cooling chamber and a solution sprayed from a solution atomizing unit, and the cooling chamber is moved up or down according to the temperature of the galvanized layer attached to the surface of the steel sheet being galvanized.

The air volume of the bottom cooler and the vertical movement of the cooling chamber are controlled by a separately provided control unit in accordance with a relative relationship between the temperature of the galvanized layer attached to the surface of the steel sheet and a reference temperature set according to the condition of the galvanized layer.

The temperature of the steel sheet entering the cooling chamber is 419° C. or more and the temperature of the steel sheet exiting the cooling chamber is 418° C. or less.

The temperature of the galvanized layer attached to the surface of the steel sheet is measured by optical thermometers set at an emissivity of 0.12 and installed above and below the cooling chamber, and a reference temperature for the initiation of solidification is 340° C., and a reference temperature for the termination of solidification is 380° C.

The air volume of the bottom cooler is controlled as follows: when $T_{pt}$-$T_{pb}$ is 20° C. or less, and at the same time, $T_{pb}$ and $T_{pt}$ are greater than Ts, or when $T_{pt}$-$T_{pb}$ is greater than 20° C., and at the same time, $T_{pb}$ is smaller than Tl, and $T_{pt}$ is between Ts and Tl, the air volume of the bottom cooler is reduced; when $T_{pt}$-$T_{pb}$ is 20° C. or less, and at the same time, $T_{pb}$ is smaller than Ts, and $T_{pt}$ is greater than Ts, the air volume of the bottom cooler is increased; and when $T_{pt}$-$T_{pb}$ is greater than 20° C. and at the same time, $T_{pb}$ is smaller than Tl, and $T_{pt}$ is greater than Ts, the air volume of the bottom cooler is maintained.

Here, $T_{pt}$ is a temperature measured by an optical thermometer set at an emissivity of 0.12 and installed above the cooling chamber, $T_{pb}$ is a temperature measured by an optical thermometer set at an emissivity of 0.12 and installed below the cooling chamber, Tl is a reference temperature for a molten galvanized layer input to the control unit, and Ts is a reference temperature for a solidified galvanized layer input to the control unit.

The vertical movement of the cooling chamber is controlled as follows: when $T_{pt}$-$T_{pb}$ is greater than 20° C., and at the same time, $T_{pb}$ is smaller than Tl, and $T_{pt}$ is between Ts and Tl, the position of the cooling chamber is maintained; when $T_{pt}$-$T_{pb}$ is 20° C. or less, and at the same time, $T_{pt}$ and $T_{pb}$ are greater than Ts, the cooling chamber is moved down, and after the cooling chamber is moved down, when $T_{pt}$-$T_{pb}$ is 20° C. or less, and at the same time, $T_{Pb}$ is smaller than Ts, and $T_{pt}$ is greater than Ts, the cooling chamber is moved further down; and when $T_{pt}$-$T_{pb}$ is greater than 20° C., and at the same time, $T_{pb}$ is smaller than Tl, and $T_{pt}$ is between Ts and Tl, the cooling chamber is moved up.

Here, $T_{pt}$ is a temperature measured by an optical thermometer installed above the cooling chamber, $T_{pb}$ is a temperature measured by an optical thermometer installed below the cooling chamber, Tl is a reference temperature for a molten galvanized layer input to the control unit, and Ts is a reference temperature for a solidified galvanized layer input to the control unit.

The ionic wind is generated by an ionic-wind generator in which a direct-current high voltage is superposed with a pulse high voltage, and is characterized in that the flow velocity thereof is increased by air supplied from an air injection device installed at the rear of the ionic-wind generator.

Advantageous Effects

According to the present invention, since the occurrence of surface defects can be minimized, a hot-dip galvanized steel sheet having excellent surface quality can be manufactured.

DESCRIPTION OF DRAWINGS

FIG. 1 is a photograph showing an example of a comb pattern defect on a surface of a hot-dip galvanized layer.

FIG. 2 is a photograph showing an example of a pitting mark defect on a surface of a hot-dip galvanized layer.

FIG. 3 is a conceptual diagram of a galvanizing apparatus of the present invention.

FIG. 4 is a front view of a wire-type charged electrode of an ionic-wind generator of the present invention.

FIG. 5 is a front view of a needle-type charged electrode of an ionic-wind generator of the present invention.

FIG. 6 is a graph illustrating the effect of using direct-current high voltage and pulse high voltage according to the present invention.

FIG. 7 is a chart illustrating an example of an improvement in solution spraying efficiency due to the use of a high voltage according to the present invention.

FIG. 8 shows the results of measuring the temperature of a steel sheet after hot-dip galvanization (emissivity is set at 0.093 for optical thermometers).

FIG. 9 shows the exemplary results of measuring the temperature of a steel sheet after hot-dip galvanization (emissivity is set at 0.12 for optical thermometers).

FIG. 10 shows an example of temperature values measured by an optical thermometer according to the position of a cooling chamber.

FIG. 11 is a three-dimensional schematic diagram of a bottom cooler of the present invention.

FIG. 12 is a logic for controlling the vertical movement of a cooling chamber when emissivity is set at 0.12 (when Ts>Tl).

FIG. 13 is a logic for controlling the air volume of a bottom cooler when emissivity is set at 0.12 (when Ts>Tl).

MODES OF THE INVENTION

One aspect of the present invention provides a method of manufacturing a hot-dip galvanized steel sheet having excellent surface quality.

As shown in FIG. 3, the method is carried out in an apparatus for manufacturing a hot-dip galvanized steel sheet, and includes a process in which a hot-dip galvanized layer is formed on a surface of a steel sheet as the steel sheet passes through a galvanizing pot 1, a thickness of the galvanized layer formed on the surface of the steel sheet is adjusted as the galvanized layer passes through a gas wiping apparatus 2, the steel sheet whose galvanized layer thickness is adjusted is primarily cooled while passing through a bottom cooler 3, and the primarily cooled galvanized steel sheet is secondarily cooled while passing through a cooling chamber 4.

In particular, the primary cooling is carried out using cooling air supplied from the bottom cooler 3 until immediately before a galvanizing solution in the galvanized layer attached to the surface of the steel sheet solidifies, and the air volume is adjusted according to the temperature of the galvanized layer attached to the surface of the steel sheet.

The secondary cooling is carried out from a time point at which the solidification of the galvanizing solution in the galvanized layer attached to the surface of the steel sheet begins to a time point at which the solidification ends, by using ionic wind generated by an ionic-wind generator 5 provided in the cooling chamber 4 and a solution sprayed from a solution atomizing unit 6, and the cooling chamber 4 is moved up or down according to the temperature of the galvanized layer attached to the surface of the steel sheet being galvanized.

Hereinafter, the present invention will be described in detail.

In the present invention, in a hot-dip galvanizing process such as shown in FIG. 3, a steel sheet thermally treated in an annealing furnace is immersed in a galvanizing pot 1 and passed through the pot, the amount of attached galvanizing material is adjusted using a gas wiping apparatus 2, and the cooling of the steel sheet is carried out in a galvanized-layer cooling apparatus installed along a steel plate movement path above the gas wiping apparatus 2.

The cooling apparatus includes a cooling chamber 4, a chamber vertical driving device 10, and a bottom cooler 3.

The cooling chamber 4 consists of an ionic-wind generator 5 and a solution atomizing unit 6 configured to spray a solution, and the cooling chamber has the cooling ability to initiate and complete the solidification of a galvanized layer.

The ionic-wind generator 5 includes a high-voltage charged electrode such as illustrated in FIG. 4 or FIG. 5. The charged electrode is fixed by a support 14, and a plurality of needles 17, whose tips are directed toward the steel plate, are fixed in a row to a plurality of wires 15, which are installed along the width direction of the steel sheet and are parallel to each other and face a wide side of the steel sheet, or to the support so that the needles are arranged along the width direction of the steel plate and are parallel to each other, and tips of the needles are fixed so that they face the wide side of the steel sheet. There are one or more such wires or rows of needles, and they are arranged along the moving direction of the steel sheet and connected to a high-voltage generating device 16 capable of supplying a high voltage having a maximum voltage of −10 to −60 kV.

When electricity is applied to the charged electrode, corona discharge occurs at the charged electrode and thus ionic wind is generated, and since the ionic wind is directed toward the steel sheet, the steel sheet is cooled by the ionic wind.

The ionic wind is generated as follows. When corona discharge occurs in air, 1 to 2% of the electrical energy is converted into the kinetic energy of gas particles and causes air to flow. That is, ions discharged during the corona discharge collide with air molecules, causing the air molecules to move in the same direction as the ions, and a combination of such movements of the air molecules is finally used as wind power.

An air injection device 7 may be attached to increase the cooling effect of the ionic wind by supplying air from the outside of the cooling chamber to the inside of the cooling chamber. When air is supplied from the air injection device 7 toward the steel sheet, since the airflow directed toward the steel sheet is increased, the flow velocity of the ionic wind generated in the charged electrode is increased, which is effective for cooling.

The air injection device is installed at a rear end of the charged electrode, and the distance of the steel sheet to the air injection device should be more than twice the distance of the steel sheet to the charged electrode. When the distance to the air injection device is less than twice the distance to the charged electrode, the ionic wind is not directed toward the steel sheet, reducing the cooling effect.

In the air injection device 7, air injection holes are arranged in parallel along the width direction of the steel sheet, and one or more slit-type nozzles can be used. In addition, as the air injection device of the present invention, a device capable of causing air to flow toward the steel sheet using a rotating motor and a rotating fan can also be used.

A solution atomizing unit 6 is installed above, below, or above and below the ionic-wind generator 5. The solution atomizing unit includes a plurality of solution spray nozzles 11 configured to spray a solution into the space between the charged electrode and the steel sheet, the spray angle of which is adjusted so that the solution does not penetrate the charged electrode. That is, in the solution atomizing unit, one or more rows of nozzle bundles, in which two or more solution spray nozzles 11 are horizontally aligned along the width direction of the steel plate, may be provided along the vertical direction.

The solution spray nozzles of the solution atomizing unit 6 installed above, below, or above and below the corona-charged electrode spray a solution into the space between the charged electrode and the steel sheet at an angle that does not allow the solution to come into contact with the charged electrode or penetrate the charged electrode. Since the direction of spraying is controlled so that the sprayed solution droplets do not come into contact with the charged electrode or penetrate the charged electrode, a drop mark defect, which occurs when a solution condensed and grown into large droplets on a charged electrode adheres to a surface of a steel sheet, can be prevented.

In addition, since the aqueous solution droplets sprayed into the space between the charged electrode and the steel sheet are moved toward the steel sheet by the ionic wind, the cooling effect is further increased.

In the solution spraying device, when there are two or more rows of the spray nozzles 11, the spraying angle of the nozzles may be in the range of 0 to 45 degrees with respect to the moving direction of the steel sheet, and different nozzle rows may have different spraying angles.

As the solution spray nozzle 11 of the present invention, any nozzle which has an air spraying pressure of 1 to 5 $kgf/cm^2$, sprays a solution by the principle of a siphon, and produces droplets of which at least 99% have a size of 100 μm or less can be used.

In addition, as the solution spray nozzle used in the cooling apparatus of the present invention, a high-pressure spray nozzle which has an air spraying pressure range of 1 to 5 $kgf/cm^2$ and a solution spraying pressure range of 1 to 4 $kgf/cm^2$, and produces droplets of which at least 99% have a size of 100 μm or less can be used. When less than 99% of droplets have a size of 100 μm or less, the large droplets increase the risk of pitting marks. The solution pressurizing device and solution storage tank required for spraying the solution are not particularly limited, and are sufficient if they are types used for typical high-pressure solution spraying.

According to the experiments of the present inventors, as the intensity of the high voltage increases, the intensity of the ionic wind directed toward a surface of the steel sheet is increased, and thus, the adhesion efficiency of droplets adhering to the steel sheet is increased. In addition, since the amount of aqueous solution droplets adhering to the steel sheet by the ionic wind increases, the cooling effect is increased.

When a high voltage of −2 to −60 kV is applied to the charged electrode as a voltage for generating ionic wind in the present invention, ionic wind that blows in the direction from the charged electrode to the steel sheet is generated.

When the voltage is less than −2 kV, it is difficult to design the cooling apparatus because the steel sheet should be placed very close to the charged electrode to generate ionic wind.

When a peak high voltage is more than −60 kV, the costs of insulating the apparatus are increased. In addition, although there is no problem in generating ionic wind under normal conditions even when only a direct-current power source is used, in some cases, partial discharge may occur due to the sensitive reaction of direct current to irregularities such as projections on an electrode surface, and therefore, there is a probability that the generation of ionic wind becomes non-uniform.

A more stable ionic wind can be generated by superposing a direct-current high voltage of −1 to −30 kV with a pulse-type high voltage of −1 to −30 kV and using the same as the high voltage for generating ionic wind. That is, when direct-current electricity is superposed with pulse electricity and used, a discharge current is uniformly formed at an electrode surface, and thus, the flow velocity of the ionic wind is stably maintained.

On the other hand, when only a pulse high voltage is used, a pulse high-voltage generator should be large enough to fully supply the necessary current. When pulse high voltage is superposed to direct-current high voltage and used, a smaller pulse high-voltage generator can be used.

FIG. 6 shows the effect of using a pulse power source superposed with a direct-current power source. The intensity of an ionic wind is determined by the amount of ions discharged from the charged electrode and thus can be indirectly measured by way of measuring the amount of current flowing between the steel sheet and the charged current while changing the intensity of an applied high voltage. When a direct-current high voltage was used, the amount of discharge current was about 4 mA at a voltage of 50 kV. When a combination of a direct-current voltage of 16 kV and a high voltage with a frequency of 20 Hz was used, at a peak voltage of 40 kV, the amount of discharge current was 17 mA, which was at least four times the amount of discharge current when only direct-current voltage was used. From this, it can be seen that the use of a combination of direct-current voltage and pulse high voltage is more effective in increasing the flow velocity of ionic wind.

Characteristics of a pulse power source include pulse generation frequency (frequency) and application time (pulse width). The present invention proposes that the characteristics of the pulse high voltage are sufficient if the pulse generation frequency is 10 to 1000 pulses/second and the pulse width is 10 to 100 ms.

FIG. 7 shows an example of measuring the number of attached droplets per 1 $mm^2$ of a steel sheet surface while changing the intensity of the high voltage in order to evaluate the effect of high voltage application on the improvement of droplet adhesion efficiency to the steel sheet during the cooling of the steel sheet using the apparatus of the present invention. As the intensity of the high voltage increased from −30 kV to −40 kV, the number of droplets increased from 60 to 80. When a pulse high voltage having a pulse width of 100 μs, a pulse generation frequency of 100 Hz. and a peak voltage of −15 kV was superposed with a direct-current high voltage of −30 kV and applied so that a total peak voltage was −45 kV, the number of attached droplets was 130, which shows that the superposition of the pulse power increased droplet adhesion efficiency by 60% as compared to when −40 kV direct-current power was applied.

In the above, it has been described that the use of direct-current electricity superposed with pulse electricity as proposed in the present invention increases the cooling ability of the cooling chamber by increasing the flow velocity of ionic wind at the same time as increasing the adhesion efficiency of aqueous solution droplets sprayed into the space between the charged electrode and the steel sheet adhering to the steel sheet.

In order to reduce the occurrence of a linear comb pattern defect using the cooling apparatus, it is preferable that the solidification of the steel sheet begins and ends while the steel sheet passes through the cooling apparatus. That is, since molten zinc containing aluminum at 0.2 to 0.3 wt % typically solidifies at a temperature of about 418 to 419° C., it is preferable that the temperature of the cooling chamber satisfies the above range while the steel sheet passes therethrough. That is, when the steel sheet enters the cooling chamber at a temperature of less than 418° C., or when the steel sheet exits the cooling chamber at a temperature of more than 419° C., the effect of the present invention is reduced.

The height at which the solidification of the galvanized layer in a molten state occurs while the steel sheet leaving the galvanizing pot moves upward varies depending on the temperature of the steel sheet immersed in the galvanizing bath, the temperature of the galvanizing pot, the thickness of the steel sheet, the amount of attached galvanizing material, the temperature of air in the factory, and the like, and the thicker the steel sheet thickness, or the greater the amount of attached galvanizing material, or the higher the temperature of the galvanizing pot, the higher and more distant from the galvanizing pot the solidification point is. Therefore, it is more effective when there is extra space above and below the cooling chamber and a power generating motor is used to move the cooling chamber to a height where a hot-dip galvanized layer solidifies.

Since relying on operator experience to locate a point where solidification occurs during the manufacture of a galvanized steel sheet is very cumbersome and may bring a high risk of a difference in galvanized layer quality, in the hot-dip galvanizing process, a non-contact optical thermometer is installed to measure the temperature of the steel sheet, and the cooling chamber is moved up or down accordingly.

Although it is important to know the exact emissivity of an object to be measured in order to accurately measure the temperature of a steel sheet with the optical thermometer, there is a high level of uncertainty. For example, although it is generally known that the emissivity of a hot-dip galvanized layer is 0.23 and the emissivity of mirror-polished zinc is 0.05, the emissivity actually measured in the galvanizing process is often between 0.09 to 0.12. This is because the emissivity changes depending on the condition of the galvanized layer, and when measuring the temperature of a steel sheet with an optical thermometer, a measurement error inevitably occurs.

FIG. 8 is a first example of measuring the temperature of a steel sheet. FIG. 8 shows the results of immersing a steel sheet having a thickness of 1 mm in a hot-dip galvanizing bath containing aluminum at 0.22%, adjusting the amount of attached galvanizing material so that the sum of amounts on both sides become 140 g/m$^2$, and measuring the temperature of the steel sheet over time. In FIG. 8, (1) shows an example of measuring with a thermocouple, and (2) shows the results of measuring with an optical thermometer by setting emissivity at 0.093.

The steel sheet temperature measured with a sheathed thermocouple is an actual steel sheet temperature according to measurement principle. When measuring a temperature with an optical thermometer, the steel sheet temperature changes similarly to an actual steel sheet temperature measured with a thermocouple at a temperature of 419° C. or more, and at a temperature of 419° C. (temperature at which the solidification of a galvanized layer starts) or less, the temperature measured with an optical thermometer significantly decreases and thus becomes greatly different from the actual temperature measured with a thermocouple.

FIG. 9 is another example of measuring the temperature of a steel sheet. In the example shown in FIG. 9, a steel sheet having a thickness of 1.2 mm was immersed in a 440° C. hot-dip galvanizing bath containing aluminum at 0.22%, the amount of attached galvanizing material was adjusted so that the sum of amounts on both sides became 140 g/m$^2$, and the temperature of the steel sheet was measured over time. In FIG. 9, (1) shows an example of measuring with a thermocouple, and (2) shows the results of measuring with an optical thermometer by setting emissivity at 0.12.

Referring to (1) of FIG. 9 measured with a thermocouple, an actual steel sheet temperature was about 435° C. after adjusting the amount of attached galvanizing material, solidification occurred at 419° C., and the steel sheet temperature decreased after solidification was completed. However, in the case of measuring with an optical thermometer, a steel sheet temperature was 330° C. after adjusting the amount of attached galvanizing material and increased to about 380° C. after solidification was completed.

In FIGS. 8 and 9, temperature values measured with an optical thermometer are different from actual temperature values measured with a thermocouple because the emissivity of a galvanized layer is different in a molten state and a solidified state. Therefore, when the cooling chamber is driven up or down based on temperature values measured with an optical thermometer, there is a high probability that a product of non-uniform quality will be produced.

In order to solve this problem, the present invention proposes a new method of driving the cooling chamber up or down.

The function of the optical thermometer for the purpose of the present invention is not to accurately measure a steel sheet temperature, but to find an exact point where the solidification of the galvanized layer occurs.

That is, since the emissivity of the galvanized layer is different before and after solidification, there is a point where the measurement error of temperature measurement with an optical thermometer becomes large, and this point corresponds to the point at which the solidification of the galvanized layer occurs.

As illustrated in FIG. 3, in the present invention, one or more optical thermometers 8 are installed above and below the cooling chamber, and the optical thermometers are set at the same emissivity value within a range of 0.04 to 0.30.

In the present invention, since the cooling chamber has the cooling ability to initiate and complete the solidification of a galvanized layer therein, the emissivity of the steel sheet is different when the steel sheet enters the cooling chamber and when the steel sheet exits the cooling chamber. Due to this change of emissivity, temperature values measured with the upper and lower optical thermometers are significantly different, even though actual steel sheet temperatures are not significantly different. Therefore, it is possible to locate a point where solidification occurs by locating a point where the difference between temperatures measured with the upper and lower optical thermometers is large.

When the driving motor control unit 12 of FIG. 3 is configured using the above-described phenomenon, the cooling chamber can be automatically driven up or down without operator intervention.

The control principle of the driving motor control unit 12 will be described in more detail below.

The present invention provides a cooling apparatus which includes: a control unit 12 configured to drive a vertical driving device so that the cooling chamber is positioned in a section where a temperature value measured with an optical thermometer installed above, $T_{pt}$, and a temperature value measured with a pyrometer installed below, $T_{pb}$, are different by at least 20° C.; and a cooling chamber vertical driving device 10.

When a temperature value measured by an upper optical thermometer is referred to as $T_{pt}$, and a temperature value measured by a lower optical thermometer is referred to as $T_{pb}$, when $T_{pt}$-$T_{pb}$ is 20° C. or more, it means that the solidification of a galvanized layer starts and ends in the cooling chamber.

The method of driving the cooling chamber up or down proposed in the present invention can be described below with reference to FIG. 10 illustrating a case where an emissivity of 0.12 was set for an optical thermometer.

In a continuous hot-dip galvanizing line, the temperature of the steel sheet which has left the galvanizing pot 1 decreases as the steel sheet is cooled while it moves upward. However, when emissivity is set at 0.12 for an optical thermometer, the temperature may be measured as having increased rather than decreased. That is, the temperature of a galvanized layer is measured to be lower than 340° C. in a molten state, and is measured to be 380° C. or more when solidification is completed. Therefore, a reference temperature value Tl representing a molten state in FIG. 10 can be set at 340° C. and a reference temperature Ts representing a solidified state can be set at 380° C.

In FIG. 10, (3-1) represents a case in which the cooling chamber is positioned low and the galvanized layer that passes through the cooling chamber is in a molten state. Here, ($T_{pt1}$-$T_{pb1}$) is 20° C. or less, and $T_{pb1}$ and $T_{pt1}$ are measured to be lower than 340° C. In this case, the cooling chamber should be moved up.

(3-3) of FIG. 10 represents a case in which the cooling chamber is positioned higher than a height proposed in the present invention. That is, in this case, the galvanized layer is already solidified before passing through the cooling chamber. Here, ($T_{pt3}$-$T_{pb3}$) is less than 10° C., and $T_{pb3}$ and $T_{pt3}$ are measured to be higher than 380° C. In this case, the cooling chamber should be moved down.

(3-2) of FIG. 10 represents a case in which the cooling chamber is positioned at a height proposed in the present invention. That is, in this case, the galvanized layer solidifies while the steel sheet passes through the cooling chamber. Here, ($T_{pt2}$-$T_{pb2}$) is about 40° C., and the conditions $T_{pb2}$<Tl and $T_{pt2}$>Ts are satisfied. In this case, there is no need to move the cooling chamber up or down.

The control logic can be configured as follows, with reference to the illustration of FIG. 11.

FIG. 12 is an example of a control logic for moving the cooling chamber up or down when the temperature of a steel sheet measured with an optical thermometer is higher after solidification than in a molten state.

That is, when $T_{pt}$-$T_{pb}$ is 20° C. or less, and $T_{pb}$ and $T_{pt}$ are greater than Ts, the cooling chamber is moved down. After the cooling chamber is moved down, when $T_{pt}$-$T_{pb}$ is 20° C. or less, $T_{pb}$ is smaller than Ts, and $T_{pt}$ is greater than Ts, the cooling chamber is moved further down.

When $T_{pt}$-$T_{pb}$ is greater than 20° C., $T_b$ is smaller than Tl, and $T_{pt}$ is between Ts and Tl, it means that the cooling chamber has moved down excessively. In this case, the cooling chamber should be moved up.

When $T_{pt}$-$T_{pb}$ is greater than 20° C., $T_{pb}$ is smaller than Tl, and $T_{pt}$ is greater than Ts, it means that solidification occurs inside the cooling chamber. In this case, the steel sheet is cooled while maintaining the position of the cooling chamber.

In addition, the solidification of the galvanized layer may be carried out in the cooling chamber while maintaining the position of the cooling chamber and controlling the air volume of a bottom cooler 3 of FIG. 3 located between the cooling chamber and an air knife.

FIG. 13 is an example of a control logic for controlling the air volume of the bottom cooler when the temperature of a steel sheet measured with an optical thermometer is higher after solidification than in a molten state.

The following is a control logic for controlling the air volume of the bottom cooler.

When $T_{pt}$-$T_{pb}$ is 20° C. or less, and $T_{pb}$ and $T_{pt}$ are greater than Ts, the air volume of the bottom cooler is reduced.

When $T_{pt}$-$T_{pb}$ is 20° C. or less, $T_{pb}$ is smaller than Ts, and $T_{pt}$ is greater than Ts, the air volume of the bottom cooler is increased.

When $T_{pt}$-$T_{pb}$ is greater than 20° C., $T_{pb}$ is smaller than Tl, and $T_{pt}$ is between Ts and Tl, since it means that the air volume of the bottom cooler is excessively large, the air volume of the bottom cooler is reduced.

When $T_{pt}$-$T_{pb}$ is greater than 20° C., $T_{pb}$ is smaller than Tl, and $T_{pt}$ is greater than Ts, it means that solidification occurs inside the cooling chamber, and in this case, the air volume of the bottom cooler is maintained.

Although "reference values for $T_{pt}$-$T_{pb}$" and reference temperatures for Tl and Ts shown in FIG. 12 and FIG. 13 may be varied according to set emissivity values or properties of a pyrometer, the basic principles of the control logics are the same.

In addition, when emissivity is set at any value within the range of 0.04 to 0.3, the "reference value for $T_{pt}$-$T_{pb}$" may be set at about 20.

In addition, the Tl and Ts values may be set based on temperatures measured by an optical thermometer before and after solidification while monitoring the condition of the galvanized layer. Once set, the "reference value for $T_{pt}$-$T_{pb}$" and the Tl and Ts values do not need to be changed unless the optical thermometer fails.

DESCRIPTION OF REFERENCE NUMERALS

1: galvanizing pot, 2: gas wiping apparatus, 3: bottom cooler, 4: cooling chamber, 5: ionic-wind generator, 6: solution atomizing unit, 7: air injection device, 8: pyrometer, 9: solution supply device, 10: cooling chamber vertical driving device, 11: solution spray nozzle, 12: control unit, 13: steel sheet, 14: support, 15: wire, 16: high-voltage generating device, 17: charged electrode needle, 18: slit-type nozzle $T_{pt}$: temperature measured by optical thermometer installed above cooling chamber $T_{pb}$: temperature measured by optical thermometer installed below cooling chamber Tl: reference temperature for molten galvanized layer input to control unit Ts: reference temperature for solidified galvanized layer input to control unit

The invention claimed is:

1. A method of manufacturing a hot-dip galvanized steel sheet having excellent surface quality, in which:

a hot-dip galvanized layer is formed on a surface of a steel sheet as the steel sheet passes through a galvanizing pot;

a thickness of the galvanized layer formed on the surface of the steel sheet is adjusted as the galvanized layer passes through a gas wiping apparatus;

the steel sheet whose galvanized layer thickness is adjusted is primarily cooled while passing through a bottom cooler; and the primarily cooled galvanized steel sheet is secondarily cooled while passing through a cooling chamber, wherein the primary cooling is carried out using cooling air supplied from the bottom cooler until immediately before a galvanizing solution in the galvanized layer attached to the surface of the steel sheet solidifies, and a volume of the air is adjusted according to a temperature of the galvanized layer attached to the surface of the steel sheet, and the secondary cooling is carried out from a time point at which the solidification of the galvanizing solution in the galvanized layer begins to a time point at which the solidification ends, by using ionic wind generated by an ionic-wind generator provided in the cooling chamber and a solution sprayed from a solution atomizing unit, and the cooling chamber is moved up or down according to the temperature of the galvanized layer attached to the surface of the steel sheet being galvanized.

2. The method of claim 1, wherein the adjustment of the volume of the air of the bottom cooler and the up or down movement of the cooling chamber are controlled by a separately provided control unit in accordance with a relative relationship between the temperature of the galvanized layer attached to the surface of the steel sheet and a reference temperature set according to a condition of the galvanized layer, and a temperature of the steel sheet entering the cooling chamber is 419° C. or more, and a temperature of the steel sheet exiting the cooling chamber is 418° C. or less.

3. The method of claim 2, wherein the temperature of the galvanized layer attached to the surface of the steel sheet is measured by optical thermometers set at an emissivity of 0.12 and installed above and below the cooling chamber, and a reference temperature for initiation of the solidification is 340° C., and a reference temperature for termination of the solidification is 380° C.

4. The method of claim 3, wherein the volume of the air of the bottom cooler is controlled as follows:

when $T_{pt}$-$T_{pb}$ is 20° C. or less, and at the same time, $T_{pb}$ and $T_{pt}$ are greater than Ts, or when $T_{pt}$-$T_{pb}$ is greater than 20° C., and at the same time, $T_{pb}$ is smaller than Tl, and $T_{pt}$ is between Ts and Tl, the volume of the air of the bottom cooler reduced;

when $T_{pt}$-$T_{pb}$ is 20° C. or less, and at the same time, $T_{pb}$ is smaller than Ts, and $T_{pt}$ is greater than Ts, the volume of the air of the bottom cooler is increased; and when $T_{pt}$-$T_{pb}$ is greater than 20° C., and at the same time, $T_{pb}$ is smaller than Tl, and $T_{pt}$ is greater than Ts, the volume of the air of the bottom cooler is maintained, (wherein, $T_{pt}$ is a temperature measured by the optical thermometer set at an emissivity of 0.12 and installed above the cooling chamber, $T_{pb}$ is a temperature measured by the optical thermometer set at an emissivity of 0.12 and installed below the cooling chamber, Tl is a reference temperature for a molten galvanized layer input to the control unit, and Ts is a reference temperature for a solidified galvanized layer input to the control unit).

5. The method of claim 3, wherein the up or down movement of the cooling chamber is controlled as follows:

when $T_{pt}$-$T_{pb}$ is greater than 20° C., and at the same time, $T_{pb}$ is smaller than Tl, and $T_{pt}$ is between Ts and Tl, the position of the cooling chamber is maintained;

when $T_{pt}$-$T_{pb}$ is 20° C. or less, and at the same time, $T_{pt}$ and $T_{pb}$ are greater than Ts, the cooling chamber is moved down, and, after the moving down of the cooling chamber, when $T_{pt}$-$T_{pb}$ is 20° C. or less, and at the same time, $T_{pb}$ is smaller than Ts, and $T_{pt}$ is greater than Ts, the cooling chamber is moved further down; and when $T_{pt}$-$T_{pb}$ is greater than 20° C., and at the same time, $T_{pb}$ is smaller than Tl, and $T_{pt}$ is between Ts and Tl, the cooling chamber is moved up, (wherein, $T_{pt}$ is a temperature measured by the optical thermometer set at an emissivity of 0.12 and installed above the cooling chamber, $T_{pb}$ is a temperature measured by the optical thermometer set at an emissivity of 0.12 and installed below the cooling chamber, Tl is a reference temperature for a molten galvanized layer input to the control unit, and Ts is a reference temperature for a solidified galvanized layer input to the control unit).

6. The method of claim 2, wherein a flow velocity of the ionic wind is increased by air supplied frog an air injection device installed at the rear of the ionic-wind generator.

7. The method of claim 2, wherein the ionic wind is generated by the ionic-wind generator in which a direct-current high voltage is superposed with a pulse high voltage.

8. The method of claim 1, wherein a flow velocity of the ionic wind is increased by air supplied from an air injection device installed at the rear of the ionic-wind generator.

9. The method of claim 1, wherein the ionic wind is generated by the ionic-wind generator in which a direct-current high voltage is superposed with a pulse high voltage.

* * * * *